US006185836B1

(12) United States Patent
Zaoralek

(10) Patent No.: US 6,185,836 B1
(45) Date of Patent: Feb. 13, 2001

(54) STEAM-HEATED ROLLER WITH COOLING SYSTEM

(75) Inventor: Heinz-Michael Zaoralek, Königsbronn (DE)

(73) Assignee: Schwabische Huttenwerke GmbH, Aalen (DE)

( * ) Notice: Under 35 U.S.C. 154(b), the term of this patent shall be extended for 0 days.

(21) Appl. No.: 09/155,922

(22) PCT Filed: Apr. 9, 1996

(86) PCT No.: PCT/DE96/00622

§ 371 Date: Oct. 8, 1998

§ 102(e) Date: Oct. 8, 1998

(87) PCT Pub. No.: WO97/38161

PCT Pub. Date: Oct. 16, 1997

(51) Int. Cl.[7] ..... D06F 58/00

(52) U.S. Cl. ..... 34/119; 34/124; 34/624; 34/636

(58) Field of Search ..... 34/611, 624, 636, 34/119, 124, 125; 165/89, 90; 162/206, 207, 359.1

(56) References Cited

U.S. PATENT DOCUMENTS 4,955,433 * 9/1990 Zaoralek ..... 165/89
5,285,844 * 2/1994 Schneid ..... 165/89
5,662,572 * 9/1997 Zaoralek ..... 492/20
5,967,958 * 10/1999 Borkenhagen et al. ..... 492/46

FOREIGN PATENT DOCUMENTS 2139114 11/1994 (CA) .
1361096 7/1974 (DE) .

* cited by examiner

*Primary Examiner*—Pamela Wilson
(74) *Attorney, Agent, or Firm*—Ratner & Prestia

(57) ABSTRACT

A roller or roll heated by a gaseous heat carrier medium, preferably steam, having axially parallel peripheral passages for use in the pressing or smoothing station of paper making machines is connected to a device for the feeding and draining of the heat carrier medium so that for cooling the heated roller a cooling means is switched into the heating/cooling circuit and the direction of flow of the heat carrier medium may be reversed. Further aspects in accordance with the invention permit regulated cooling of the roller by blending heat carrier condensate into the return flow of heat carrier, by switching over between operation with a gaseous heat carrier and operation with a condensed heat carrier, as well as application of the invention in rollers having roller drive arranged on one flanged trunnion.

12 Claims, 7 Drawing Sheets

STEAM-HEATED ROLLER WITH COOLING SYSTEM

DESCRIPTION

Figure 1:
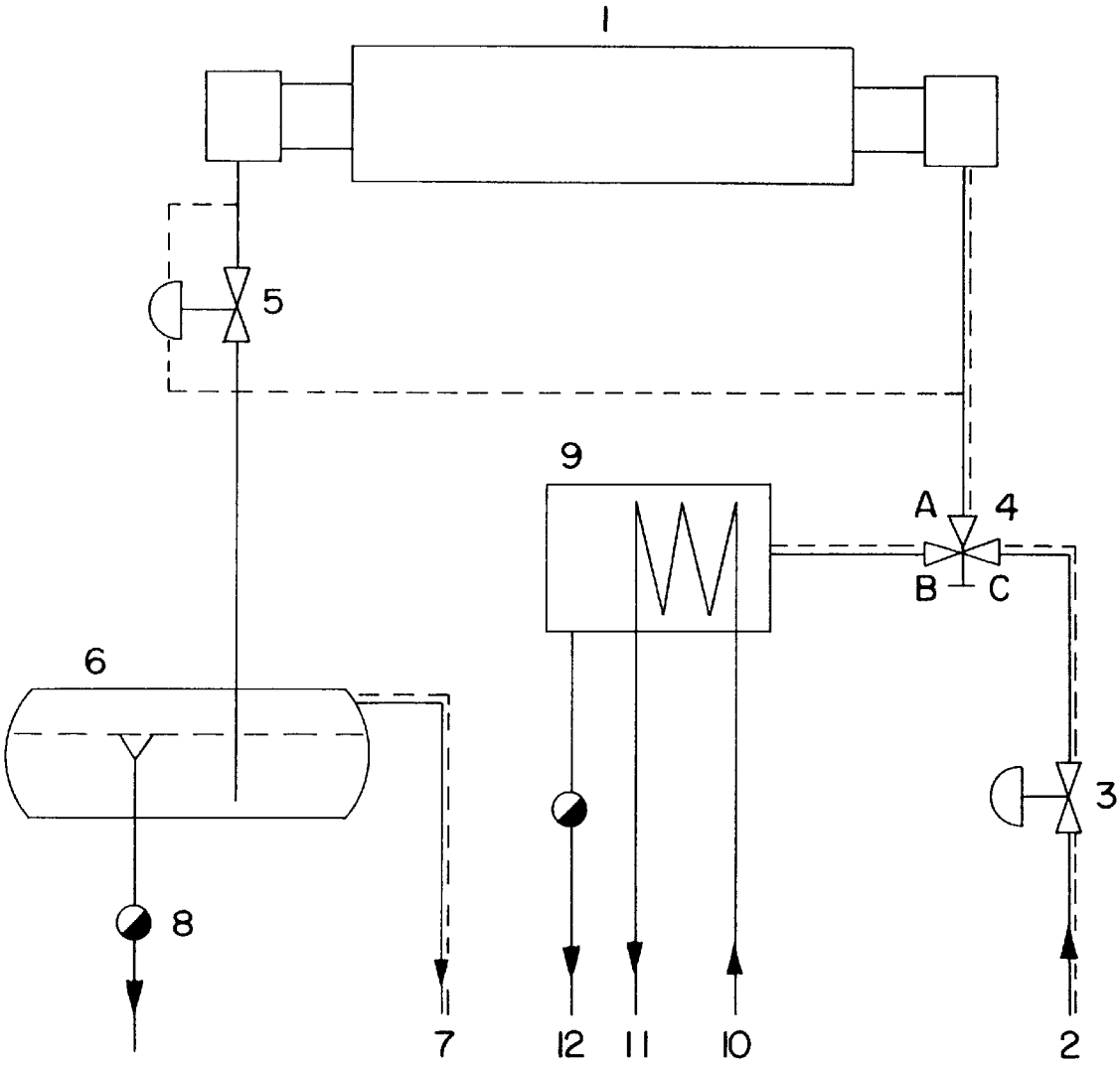
Figure 1A:
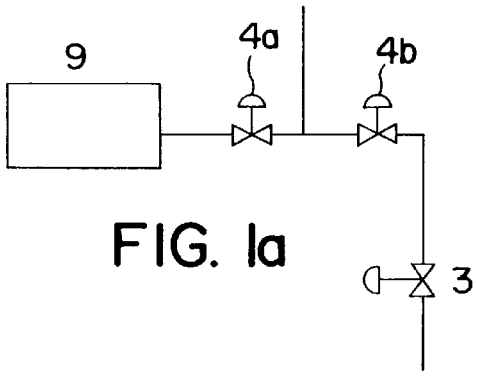

Rollers or rolls as used in paper making machines are often heated due to the various technical requirements. This usually is done by a medium serving as the heat carrier being sent through cavities in the roller, as a result of which heat is transferred to the shell of the roller, heating it up. In this arrangement both a central cavity may be provided in the roller as well as annular cavities arranged between a displacement body located in the center of the roller and its surrounding roller shell. However, just as well, passages may be arranged near to the periphery of the roller shell oriented axially parallel, evenly spaced radially from the center of the roller and thereabout. The heat carrier medium generally used is a liquid such as water or oils. It is especially in the case of the so-called smoothing station at the end of the paper making machine, in which the surface of the paper is upgraded by heated smoothing, that supplying heat to the roller requires particular care. This is why considerable efforts are made in design to achieve a consistently high heat transfer to the surface or shell of the roller over its full length.

Recently it has been recognized that it may make sense to use steam as the heat carrier medium. The advantage afforded by this choice is that considerably less quantities of the heat carrier medium are needed, thus making major savings in energy possible which result in likewise considerable cost savings in the process as a whole. In addition to this, process steam is mostly adequately available in any case in paper making. Such steam-heated rollers are described in the German patent applications DE 43 13 379 A1 and DE 44 07 239 A1 in which the steam is guided through peripheral passages in the roller shell where it condenses, giving off its thermal energy to the roller shell. Collecting spaces are provided at the corresponding ends of the passages from which the resulting condensate or condensate/steam mix may be syphoned off from the roller by syphon means.

One drawback in heating rollers with steam is that such rollers cannot be cooled. If the machine is halted for changing the roller or due to remedial action being needed in the systems connecting the roller, a wait has hitherto been necessary to allow the roller to cool down by convection and irradiation of the thermal energy to a temperature suitable for roller handling. This takes up a lot of time in view of the rollers concerned weighing anything up to a 100 tonnes and having operating temperatures of up to 200° C. which can hardly be tolerated as downtime for paper making machines which are usually operated non-stop. This is why a broad application of steam-heated rollers has failed to find acceptance.

Cooling heated rollers, or rollers having otherwise an increase in temperature, e.g. due to friction in operation has been recognized as a task for which technical solutions have been sought. Accordingly, e.g. DT 24 00 615 A1 discloses a hollow roller filled at least in part with a heat carrier medium, in the interior of which a heat exchanger is provided connected to a means of increasing or decreasing the temperature outside of the roller so that the heat carrier medium in coming into contact therewith may be heated or cooled. However, designs of this kind, irrespective of their other disadvantages, fail to qualify for cooling a steam-heated roller because the suitable heat carrier medium is lacking. On cooling, steam would simply condensate, the condensate failing to fill the interior of the roller completely.

The object of the invention is to specifically cool steam rollers and to shorten the time needed for cooling. It has been discovered that this shortening is achievable to a surprising extent, for instance, from 15 hours to 150 minutes in the case of a pertinent 70 ton roller. The invention simultaneously opens up the possibility of operating steam-heated rollers also at a temperature level which is below the steam temperature should this prove desirable or necessary for specifically reasons without having to switch the heating system over to another heat carrier. Steering the temperature of the roller in this way is also lastingly possible with a suitable roller design by steam being guided through the roller body at higher operating temperatures, and at lower temperatures, condensate, i.e. water, the temperature of which is regulated outside of the roller.

The invention will now be described with reference to FIGS. 1 to 7*b* of the drawings.

FIGS. 1, 2, 3 and 5 are flow diagrams for the heating and cooling circuit of a steam-heated roller. FIG. 1(*a*) is a partial schematic of the system of FIG. 1 showing two valves in place of the three-way valve. FIGS. 4*a*/4*b* and 6*a*/6*b* and 7*a*/7*b* are longitudinal sections through corresponding rollers. The upper half of the longitudinal section 4*a* and 6*a* shows the flow in the roller during heating, the lower half 4*b* and 6*b* during cooling. The upper half of the longitudinal section 7, 7*a* shows for lasting steam/water operation the flow in the roller in steam operation, the lower half (7*b*) in water operation. Where the direction of the flow of the temperature transfer medium is indicated, the solid black arrows indicate the flow direction of the condensate, whereas the black outlined arrows indicate the flow direction of the steam.

Referring now to FIG. 1 there is illustrated how the roller (1) is supplied with heating steam during heating operation from the steam conduit (2) via the regulating valve (3). In this arrangement the three-way valve (4) is positioned A-C. The flow per unit of time of condensate leaving the roller is regulated via a variable differential pressure valve (5) which assures a constant difference in pressure between roller input and roller output. In the steam separation container (6) the overblow steam emerging together with the condensate is separated from the condensate and fed into a steam conduit via the conduit (7). The condensate remaining in the steam separation container (6) flows back via the condensate separator (8) into a condensate conduit.

Making a changeover from heating operation to cooling operation is done by switching the three-way valve (4) to the position A-B, this shutting off the steam supply and connecting the roller input to the cooling apparatus (9)—in this case a condenser—where the temperature level is determined by the input and output flow (10)/(11) of cooling water.

Due to the temperature in the condenser (9) being lower than in the interior of the roller a vacuum pressure materializes in the condenser which draws off the steam still present in the roller. The vacuum pressure resulting accordingly in the roller draws back condensate from the steam separation container (6) into the roller, this being facilitated either by a corresponding opening of the valve (5) or by a bypass (not shown).

Due to the vacuum pressure in the roller the returned condensate evaporates, removing thermal energy from the roller. The steam continues to flow back into the condenser (9) where it condenses, the resulting condensate being drained via the condensate drain (12).

Regulating the cooling capacity is done, for example, simply by controlling the flow of cooling water through the condenser (9).

FIG. 1(*a*) shows the substitution of two separate valves 4*a* and 4*b* in place of three-way valve 4. Valve 4*a* controls flow between condenser 9 and roll 1 whereas valve 4*b* controls flow of steam between the steam valve 3 and the roller 1. If condensate is to be circulated from a condenser 9 to roll 1, valve 4*a* is opened and valve 4*b* is closed. Conversely if steam is to be conducted to the roll valve 4*b* is opened and valve 4*a* is closed.

Figure 2:
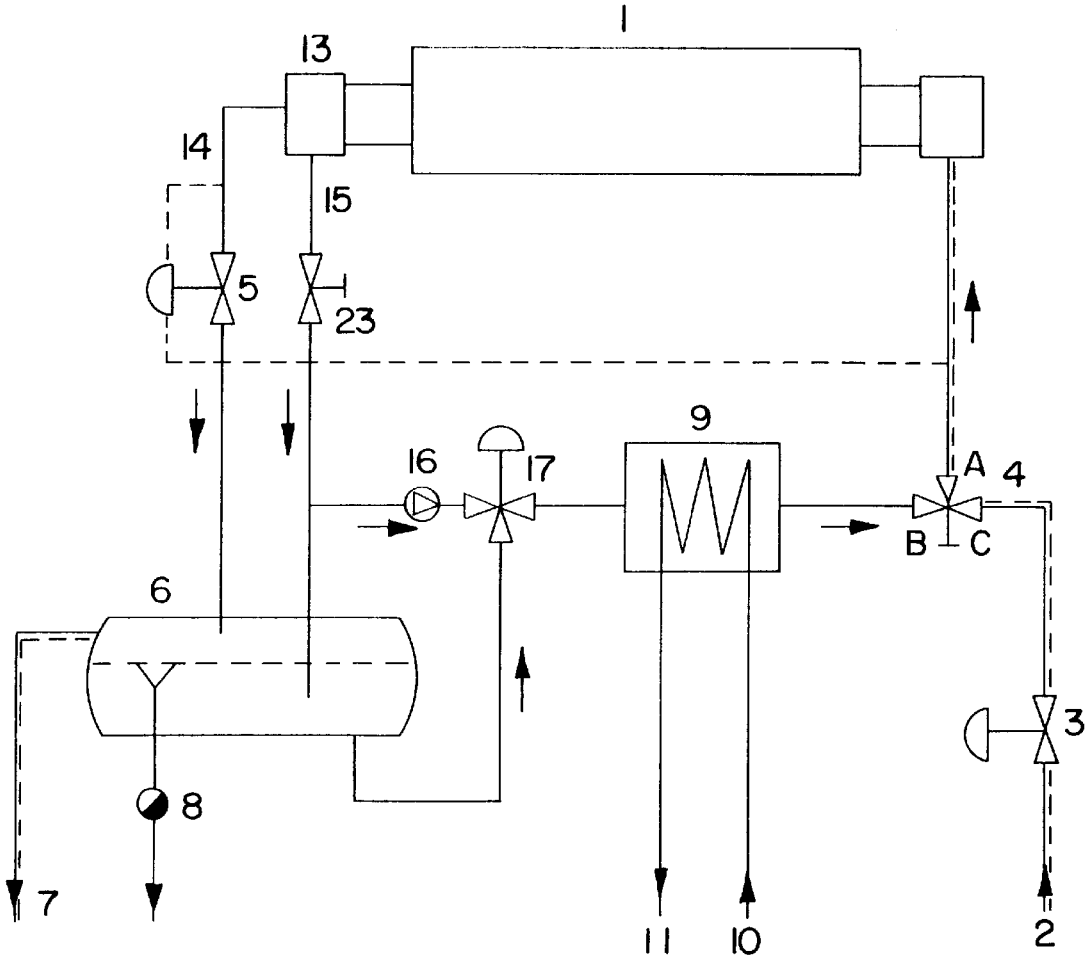

Referring now to FIG. 2 there is illustrated another method of cooling a steam-heated roller in normal operation. The corresponding roller comprises at its outlet end a so-called duplex sealing head (13).

During heating operation the condensate is drawn off through one of the two conduits (14) of the duplex sealing head (13) via the differential pressure valve (5). In this mode the valve (23) and thus the second drain conduit (15) from the duplex sealing head (13) are closed.

For changing over to cooling operation the three-way valve (4)—as already indicated—is switched to position A-B, the differential pressure valve (5) closed and valve (23) opened, thus producing a circuit via the condenser (9), the flow of which is maintained by the circulating pump (16). Regulating the temperature below the steam temperature level is now possible either by a three-way valve (17), via which a specific flow of hot condensate may be admixed in the circuit from the steam separation container (6), or by the flow of cooling water through the cooling apparatus (9) into the conduits (10)/(11).

With driven rollers it is usually so that one side of the roller is not available for a sealing head due to the drive. In this case a duplex sealing head may be employed as evident from the configuration shown in FIG. 1, whereas a triple sealing head would be necessary for the configuration as evident from FIG. 2. This is not particularly difficult technically since the third connection for the condensate drain requires only a small diameter and may be integrated additionally in a duplex sealing head.

Figure 3:
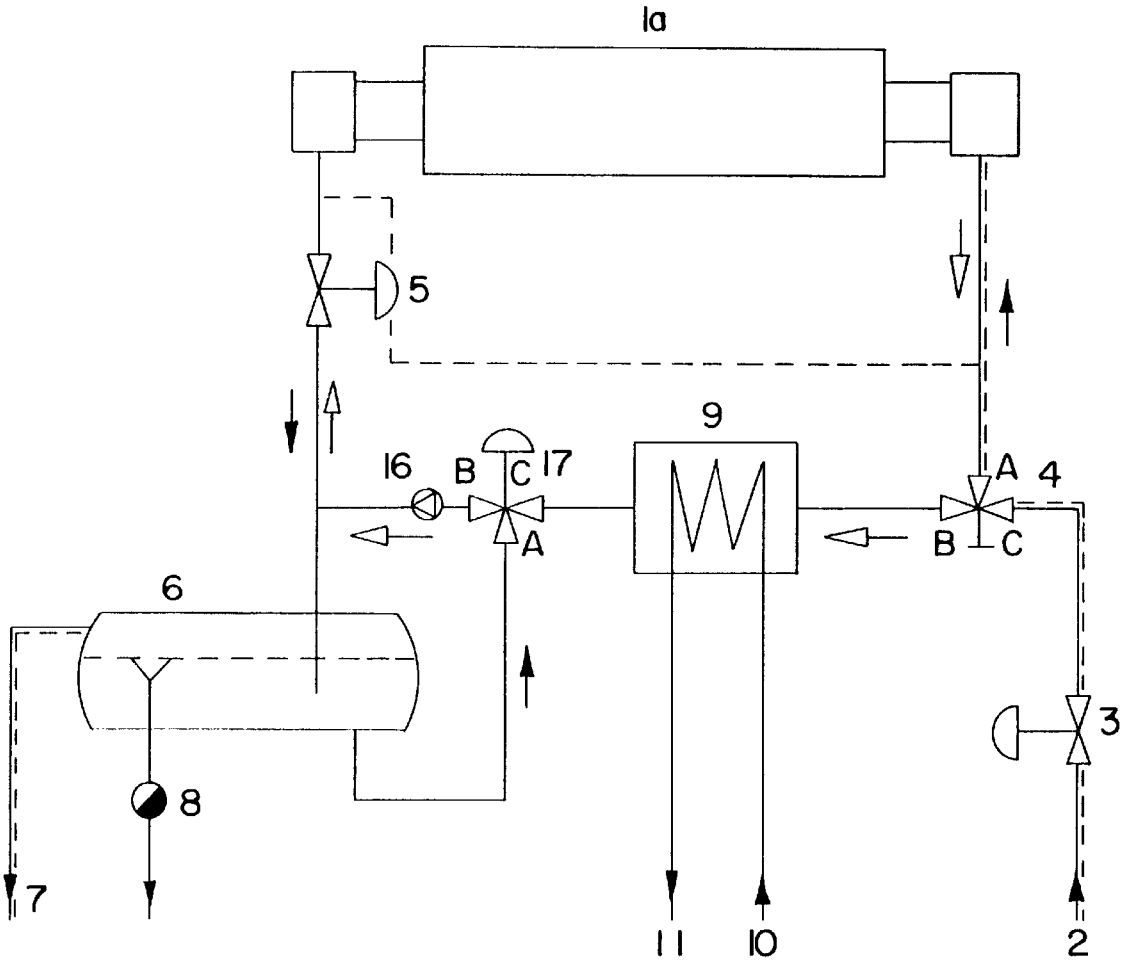
Figure 4A:
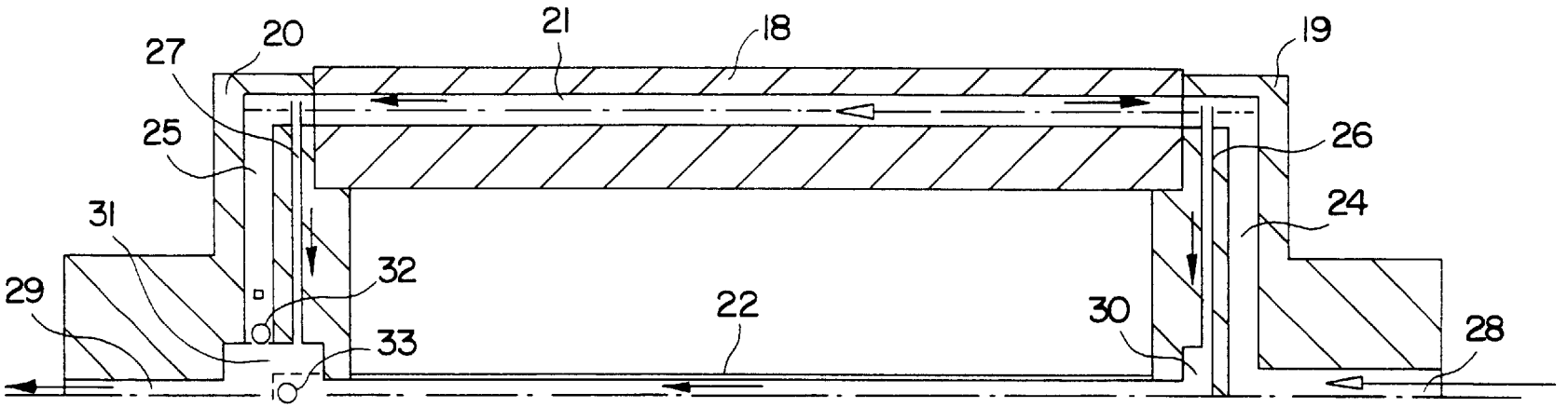
Figure 4B:
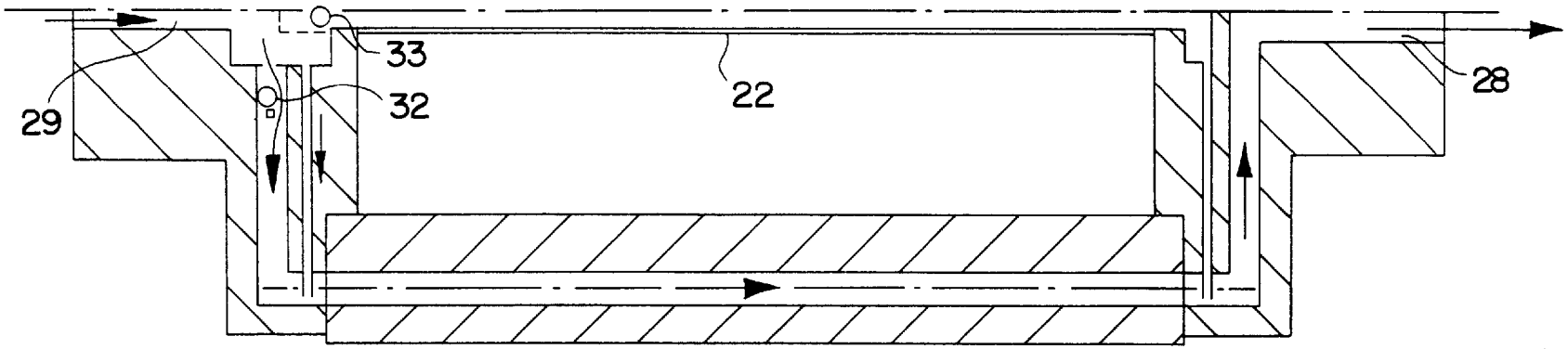

Referring now to FIG. 3 as well as FIGS. 4*a* and 4*b* there is illustrated a further configuration of the roller in accordance with the invention along with its heating and cooling regulating circuit showing how the design aspects of the roller in it being switched from one mode to the other contribute towards operation. Heating operation as shown in FIG. 3 (solid black arrows) is as already described relative to FIGS. 1 and 2.

For cooling operation, firstly the valve (4) is switched to the position A-B and valve (5) opened. Due to the resulting vacuum pressure, condensate flows back into the roller. By switching the valve (17) to the position A-B it is possible to accelerate the fill through the circulating pump (16).

Cooling operation then follows in the opposite direction (black outlined arrows). The valve (17) is positioned to B-C. The circulating pump (16) circulates the condensate clockwise through the roller. The cooling capacity is dictated for example by the cooling water flow through the cooling apparatus (9) in the feed and drain conduits (10) and (11).

The sequence of events in the roller is thereby as shown in FIGS. 4*a* (heating operation) and 4*b* (cooling operation). In a heating operation steam flows through the inlet bore (28) into the trunnion (19). The steam gains access from there via the connecting channels (24) to the peripheral passages (21) in the roller body (18) where it condenses and gives off its thermal energy. Due to a difference in pressure between inlet bore (28) and outlet bore (29) set outside of the roller the condensate formed is syphoned off via the syphon tubes (26) and (27) into the collecting spaces (30) and (31) and is forced from there into the outlet bore (29). In this arrangement the condensate materializing in the region of the inlet bore (28) is still able to pass through the connecting tube (22) and the valve (33) is still open at this point in time. The valves (32) are closed, preventing steam flowing through via the connecting channels (25).

In cooling operation as evident from FIG. 4*b* the direction of flow within the roller is reversed. Cooled condensate flows through the outlet bore (29) in the trunnion (20) and forces the valves (32) open so that it is able to gain access via the connecting channels (25) to the peripheral passages (21) where it absorbs heat from the roller body (18). A minor flow of condensate also passes through the syphon tubes (27). However, the valve (33) closes so that no condensate is able to gain access through the connecting tube (22) to the trunnion (19). The condensate heated in the peripheral passages flows via the connecting channels (24) to the bore (28) and from there, out of the roller.

In another aspect, preferably for driven rollers, the valve system (32)/(33) is integrated in the trunnion (19) so that steam and condensate feeding/draining are unified in this one trunnion.

Figure 5:
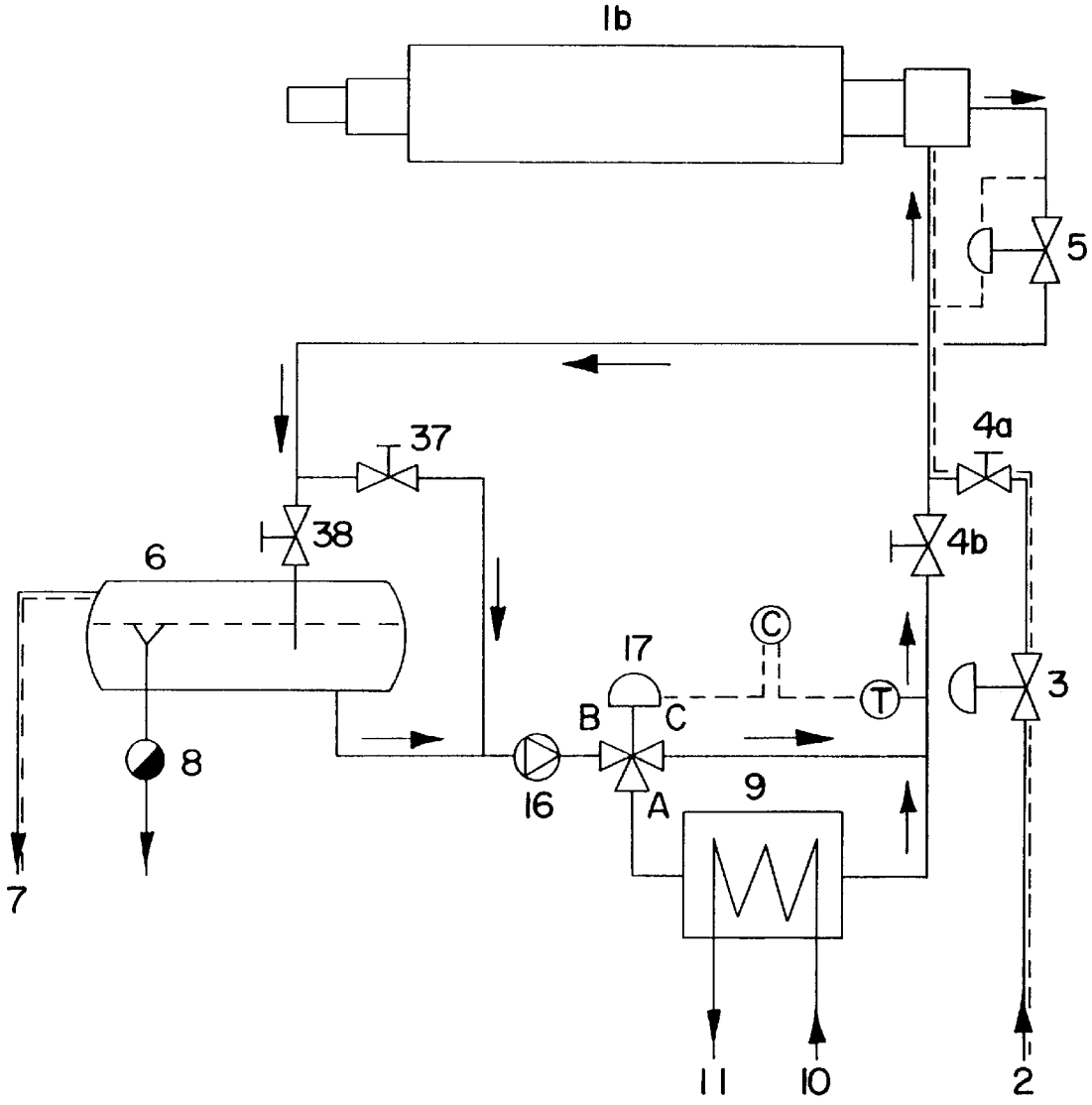
Figure 6A:
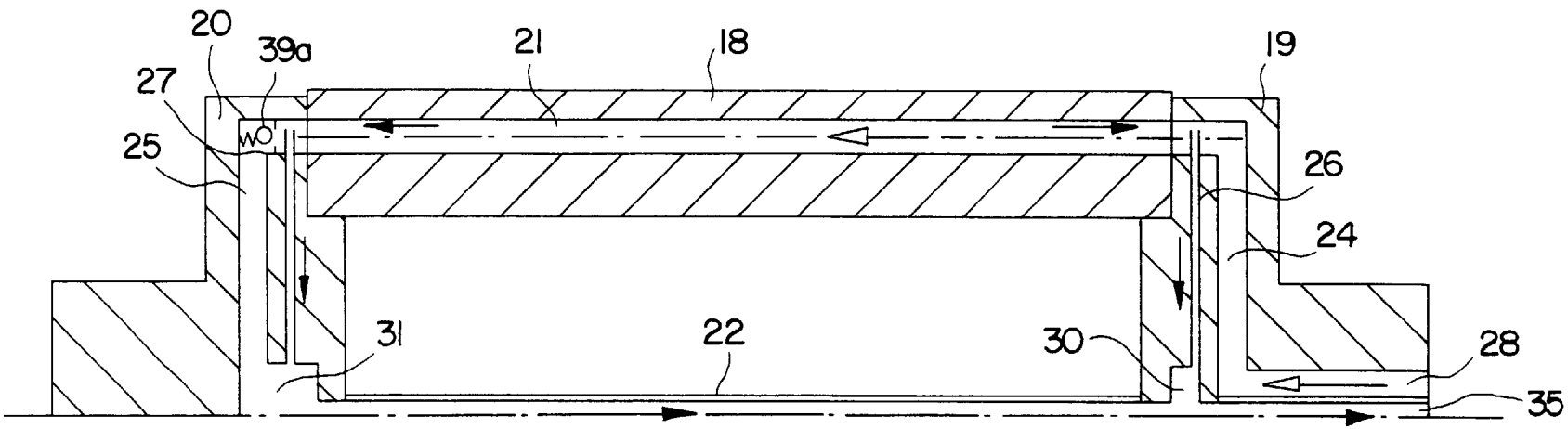
Figure 6B:
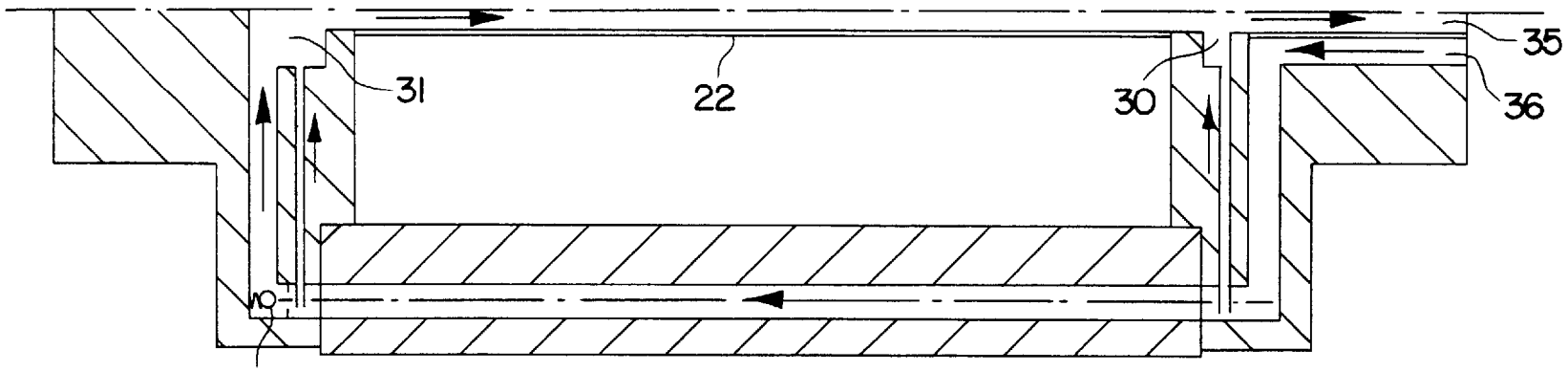

Referring now to FIG. 5 as well as to FIGS. 6*a* and 6*b* there is illustrated yet a further aspect of the invention. For cooling, as shown in FIG. 5, the valve 4*a* is first closed in the steam feeder conduit and valve 4*b* opened. The three-way valve (17) is positioned C-B. Hot condensate is forced into the roller from the condensate container (6) by the circulating pump (16). Depending on the pressure in the condensate container and the difference in level relative to the roller, the condensate evaporates partly in the roller and the roller is cooled down to the saturated steam temperature.

Once this has happened, the valve (38) is closed and valve (37) opened, the condensate container (6) then merely maintaining the system pressure, preventing any further evaporation in the circuit which is now closed. By part of the flow being redirected through the cooling apparatus (9) by means of the valve (17) the condensate in the circuit and thus the roller cool down is accordingly regulated. In this arrangement the circuit flow may be substantially below that usually necessary for operating a smoothing station in a paper making machine.

For this purpose the roller belonging to the system features the design details as evident from FIGS. 6*a* and 6*b*. As evident from FIG. 6*a*, in heating operation the connecting channels (25) in the trunnion (20) on the drive side are closed by the biased action of the valves (39*a*). Valves 39*a* are one way valves normally closed by the spring pressure on a ball closure. These valves are commonly referred to as check valves by workers skilled in the art. The differential pressure set by a valve outside of the roller is not sufficient to open these valves.

As evident from FIG. 6*b*, in cooling operation the roller is flooded with condensate, the operational circulating pump (16)—see FIG. 5—creating such a high advance pressure that the valves (39*b*) open to release the return of condensate through the connecting channels (25), as a result of which the condensate flow through the roller may be increased to such an extent that rapid cooling is made possible, for example as desired when changing rollers.

The type of system as shown in FIGS. 5 and 6*a*/*b* also permits, just like the type of system as shown in FIG. 3 along with FIGS. 4*a*/4*b*, alternative heating of the roller with steam, on the one hand, and with hot condensate, on the other. When adequately dimensioned sealing heads are employed a change may be made to condensate heating at a steam pressure below approx. 3 bar representing the lower limit for steam operation, this necessitating branching the flow in the steam conduit (2) into the condensate container (6) and to close the steam-off conduit (7) by a valve.

Figures 7A, 7B:
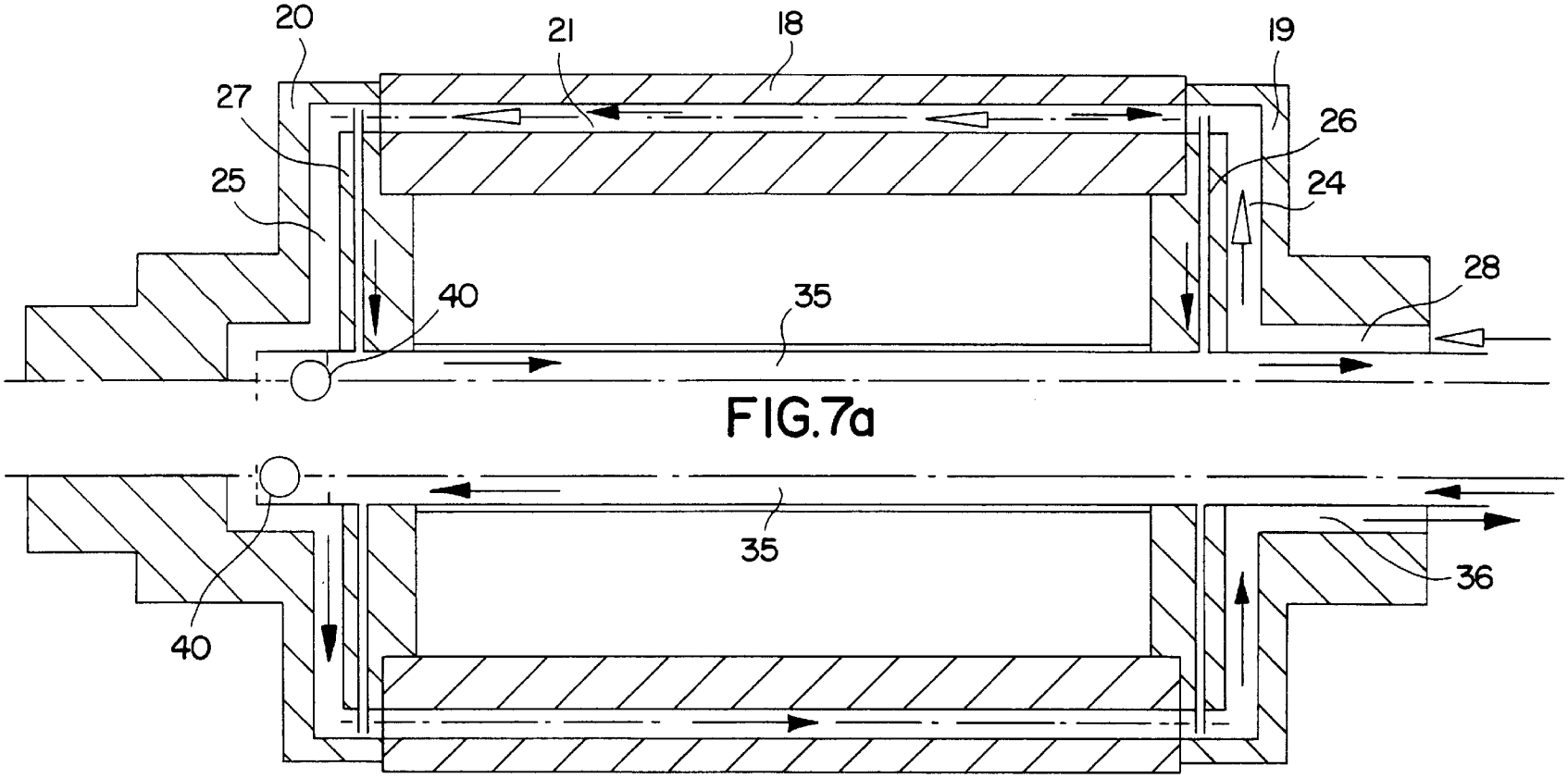

Referring now to FIGS. 7*a*/7*b* there is illustrated an aspect of the invention which has turned out to be of advantage for a lasting change-over operation between steam heating and water heating, the conditions outside of the roller as shown in FIG. 3 (heating or steam operation) or FIG. 5 (cooling or water operation) applying here, too. The sequence of events and the design of the roller are as evident from FIGS. 7*a*/7*b*, the upper half of the drawing (FIG. 7*a*) representing operation with steam, the lower half (FIG. 7*b*) showing operation with water.

In steam operation, the steam flow bypasses the center tube (35) through the inlet bore (28) and the connecting channels (24) into the peripheral passages (18). The resulting condensate is syphoned off through the syphon tubes (26)/(27) into the center tube (35), the differential pressure needed for this purpose achieved by closing the valve (40) in the trunnion (20) on the drive side and preventing fresh steam from gaining access to the center tube (35). The condensate is directed through the center tube (35) in the trunnion (19) out of the roller.

In water operation (=cooling operation) steam feed conduit (2) and condensate drain conduit (12) outside of the roller are closed and the roller is connected to the condensate conduit in the reverse direction of flow (cf. FIG. 3). The condensate entering through the center tube (35) opens the valves (40) so that it is able to flow through the connecting channels (25) into the peripheral passages (21) and thus subsequently through the connecting channels (24) into the outlet bore (36), thus resulting in a heating/cooling circuit on a condensate (water) basis.

It will be appreciated that where valves have been discussed above as being within the roller, which can be automatically opened or closed by reversing the flow, it is just as feasible to use suitable closures that may be automatically opened or closed outside of the roller by mechanical or other suitable remote control devices.

It is understood that the invention is not restricted to rollers having the aspects as evident from FIGS. 1 to 7, i.e. which are self-supporting and trunnion mounted. It is just as applicable to so-called "floating" hollow rolls mounted throughout hydraulically or in a similar fashion on a rigid axle, for instance in keeping with the design as it reads from DE-PS 38 38 726. In this case the connecting channels (24)/(25) as evident from FIGS. 4*a*/4*b*, 6*a*/6*b* or 7*a*/7*b* may be visualized as being partly located in the central axis, partly in an annular space located between the latter and the shell of the roller whilst the connecting tube (22) is located in the central axis.

In conclusion, the invention is not restricted to using the rollers as employed in paper making machines, instead it is suitable for all areas of application of heated rollers, i.e. for example in film production, in the treatment of webs of the textile and similar materials as well as in surface finishing backing materials of all kinds, including metallic types.

| List of Reference Numerals | |
|---|---|
| 1 | roller |
| 2 | steam conduit |
| 3 | regulating/control valve |

-continued

| List of Reference Numerals | |
|---|---|
| 4 | three-way valve |
| 5 | differential pressure valve |
| 6 | steam separation container |
| 7 | conduit |
| 8 | condensate separator |
| 9 | cooling apparatus |
| 10 | cooling water feed |
| 11 | cooling water drain |
| 12 | condensate drain |
| 13 | duplex sealing head |
| 14 | No. 1 drain |
| 15 | No. 2 drain |
| 16 | circulating pump |
| 17 | three-way valve |
| 18 | roller body |
| 19 | trunnion |
| 20 | trunnion |
| 21 | peripheral passage |
| 22 | connecting tube |
| 23 | valve |
| 24 | connecting channel |
| 25 | connecting channel |
| 26 | syphon tube |
| 27 | syphon tube |
| 28 | inlet port |
| 29 | outlet port |
| 30 | collecting space |
| 31 | collecting space |
| 32 | valve |
| 33 | valve |
| 35 | center tube |
| 37 | valve |
| 38 | valve |
| 39 | valve |
| 40 | valve |

What is claimed is:

1. A heatable roller or roll for a pressing or smoothing station of a paper making machine, including a roller body comprising at least one, peripheral passage or channel oriented substantially axially parallel to the roller body, at least one flanged trunnion and a gaseous heat carrier medium circulating in said passages or channels as well as at least one feed conduit for said heat carrier medium, at least one conduit for draining said heat carrier medium and the condensate thereof as well as a steam separator container (6) arranged at the end of said drain conduit, characterized in that a cooling apparatus (9) being one of a heat exchanger or a condenser having a condensate drain (12) connected to said feed conduit with means to regulate flow of said heat carrier medium into and out of said roll.

2. The heatable roller as set forth in claim 1, including pump means to fill said roller with condensate or feed water.

3. The heatable roller as set forth in claim 1, including a three-way valve having two inlet and one outlet conduits, one of said inlet conduits connected to said condenser and the other of said inlet conduits connected to a conduit for said heat carrier medium.

4. The heatable roller as set forth in claim 1, wherein said roller has an outlet end and a duplex sealing head (13) having a duplex rotary transmission, with two drain conduits connected to said steam separator container (6) and begin capable of being alternatively opened and closed by valves (5) and (23) respectively.

5. The heatable roller as set forth in claim 1, wherein connecting channels (24) and (25) leading to and from said peripheral passages or channels as well as an outlet of a connecting tube (22) between roller inlet are automatic valves (32) and (33) arranged, depending on the direction of flow of said heat carrier medium and said condensate, to open and close alternatively.

6. The heatable roller as set forth in claim 5, characterized in that at least one of said valves (32) and (33) are biased ball valves.

7. The heatable roller as set forth in claim 1, including a drive arranged on one flanged trunnion on one end of said roller and feeding and draining for said heat carrier medium and condensate through a flanged trunnion at an opposite end of said roller, including valves (39) which are closed during heating of said roller and open during cooling of said roller.

8. The heatable roller as set forth in claim 7, wherein said valves (39) are biased ball valves having a closing force which is higher than a differential pressure of said heat carrier medium in the gaseous condition and said heat carrier condensate circulated during a cooling operation, generated by a circulating pump (16) arranged in one of said heat carrier feed or drain conduit.

9. The heatable roller as set forth in claim 7, including a feed conduit for said heat carrier medium (2) directed into said steam separation container (6) and said drain conduit for said heat carrier medium (7) from said steam separation container (6) including shut off means and means for simultaneous operation of said circulating pump (16).

10. The heatable roller as set forth in claim 7, including a single valve arranged in said drive end trunnion, said valve closing off said center bore during steam heating and opening said center bore during condensate circulation.

11. The heatable roller as set forth in claim 1, wherein said steam separation container (6) performs as an expansion tank for said cooling unit.

12. The heatable roller as set forth in claim 1, including two valves, one of said valves controlling flow into and out of said condenser and said roller and the other of said valves controlling flow of said heat carrier medium into or out of said roller.

* * * * *